US008353146B1

(12) United States Patent
Bareford et al.

(10) Patent No.: US 8,353,146 B1
(45) Date of Patent: Jan. 15, 2013

(54) ICE BAGGING ASSEMBLY

(75) Inventors: Christopher Bareford, Concord, MA (US); James Shaker, Mesa, AZ (US); Vince Shaker, Mesa, AZ (US); Paul Bareford, Concord, MA (US); Larry Rider, Parks, AZ (US)

(73) Assignee: In-Store Bagging Machine Company, LLC, Irving, TX (US)

( * ) Notice: Subject to any disclaimer, the term of this patent is extended or adjusted under 35 U.S.C. 154(b) by 500 days.

(21) Appl. No.: 12/539,541

(22) Filed: Aug. 11, 2009

Related U.S. Application Data

(60) Provisional application No. 61/188,516, filed on Aug. 11, 2008.

(51) Int. Cl.
*B65D 63/08* (2006.01)

(52) U.S. Cl. ..... 53/440; 53/127; 53/443; 62/344

(58) Field of Classification Search ..... 53/440, 53/493, 443, 127; 62/60, 344
See application file for complete search history.

(56) References Cited

U.S. PATENT DOCUMENTS

| | | | |
|---|---|---|---|
| 2,116,300 | A | 5/1938 | Campos |
| 2,584,726 | A | 2/1952 | McOmber |
| 3,009,336 | A | 11/1961 | Bayston |
| 3,151,668 | A | 10/1964 | Zimmermann |
| 3,559,424 | A | 2/1971 | Nelson |
| 3,654,771 | A | 4/1972 | Kuebler |
| 3,712,019 | A | 1/1973 | Lamka et al. |
| 3,719,307 | A | 3/1973 | Larson |
| 3,727,374 | A | 4/1973 | Williams |
| 3,789,570 | A | 2/1974 | Mullins, Jr. |
| 3,807,123 | A | 4/1974 | Kihnke |
| 3,807,193 | A | 4/1974 | McKenney et al. |
| 3,889,449 | A | 6/1975 | Membrino |
| 3,897,676 | A | 8/1975 | Membrino |
| 3,918,266 | A | 11/1975 | Gindy et al. |
| 4,013,199 | A | 3/1977 | Brown |
| 4,132,049 | A | 1/1979 | Mullins, Jr. |
| 4,291,517 | A | 9/1981 | Lipes |
| 4,348,872 | A | 9/1982 | Hill |
| 4,368,608 | A | 1/1983 | Ray |
| 4,404,817 | A | 9/1983 | Cox, III |
| 4,541,228 | A | 9/1985 | Petersen |
| 4,607,478 | A | 8/1986 | Maglecic |
| 4,689,937 | A | 9/1987 | Finan, Sr. et al. |
| 4,878,523 | A | 11/1989 | Balsamico et al. |
| 5,070,674 | A | 12/1991 | Lerner |
| 5,088,300 | A | 2/1992 | Wessa |
| 5,109,651 | A | 5/1992 | Stuart |
| 5,277,016 | A | 1/1994 | Williams et al. |
| 5,400,838 | A | 3/1995 | Schjerven |

(Continued)

FOREIGN PATENT DOCUMENTS

| | | | |
|---|---|---|---|
| ES | 2171120 | A | 8/2002 |

(Continued)

*Primary Examiner* — Thanh Truong
(74) *Attorney, Agent, or Firm* — Booth Udall, PLC

(57) ABSTRACT

Ice bagging assemblies comprising an ice bag merchandiser, an ice bag diverter positionable between first and second positions to drop ice bags into different first and second regions within the ice bag merchandiser. Methods of stacking ice bags in an ice bag merchandiser comprising receiving an ice bag in an ice bag diverter and dropping the ice bag to a first region of the ice bag merchandiser when the ice bag diverter is in a first position and dropping the ice bag to a second region of the ice bag merchandiser when the ice bag diverter is in a second position.

20 Claims, 11 Drawing Sheets

U.S. PATENT DOCUMENTS

| | | | |
|---|---|---|---|
| 5,440,863 | A | 8/1995 | Toya et al. |
| 5,444,962 | A | 8/1995 | Bonnet |
| 5,458,851 | A | 10/1995 | Schroeder et al. |
| 5,473,865 | A | 12/1995 | Tanaka |
| 5,581,982 | A | 12/1996 | Schroeder et al. |
| 5,630,310 | A | 5/1997 | Chadwell |
| 5,822,955 | A | 10/1998 | Woosley et al. |
| D407,092 | S | 3/1999 | Weaver |
| 6,112,539 | A | 9/2000 | Colberg |
| 6,266,945 | B1 | 7/2001 | Schroeder |
| 6,354,338 | B1 | 3/2002 | Takemoto |
| 6,474,048 | B1 | 11/2002 | Metzger et al. |
| 6,827,529 | B1 | 12/2004 | Berge et al. |
| 6,904,946 | B2 | 6/2005 | James |
| 7,062,892 | B2 | 6/2006 | Metzger |
| 7,207,156 | B2 | 4/2007 | Metzger |
| 7,421,834 | B1 | 9/2008 | Doolan |
| 7,426,812 | B2 | 9/2008 | Metzger |
| 7,426,945 | B2 | 9/2008 | Dalton et al. |
| 7,497,062 | B2 | 3/2009 | Metzger |
| 7,624,773 | B2 | 12/2009 | Maxwell |
| 7,681,408 | B2 | 3/2010 | Hobson et al. |
| 2005/0051232 | A1 | 3/2005 | Schmoll |
| 2007/0267086 | A1 | 11/2007 | Dunn |
| 2008/0022635 | A1 | 1/2008 | Metzger |
| 2008/0295462 | A1 | 12/2008 | Metzger |
| 2009/0120039 | A1 | 5/2009 | Metzger |

FOREIGN PATENT DOCUMENTS

| | | | |
|---|---|---|---|
| WO | WO0001582 | A1 | 1/2000 |

ICE BAGGING ASSEMBLY

CROSS REFERENCE TO RELATED APPLICATIONS

This Application claims the benefit of the filing date of U.S. Provisional Patent Application 61/188,516 to Shaker, et al., entitled "Automatic Ice Bag Stacker for Ice Merchandisers," which was filed on Aug. 11, 2008, the disclosure of which is hereby incorporated entirely herein by reference.

BACKGROUND

1. Technical Field

Aspects of the present document relate generally to ice bagging assemblies, and more specifically to ice bagging assemblies configured to provide a plurality of sealed ice bags to consumers.

2. Background Art

Ice bagging assemblies are commonly used to fill a plurality of bags with ice for retail sales, commercial sales, and/or other uses by other consumers. Ice bagging assemblies are useful in that, among other things, they may produce and store bags of ice in a manner that is conveniently accessible to users.

SUMMARY

Aspects of this document relate to ice bagging and merchandising assemblies. In one aspect, an ice bagging assembly may comprise an ice bagging apparatus configured to generate a plurality of ice cubes and seal them in a plurality of ice bags, an ice bag merchandiser in mechanical cooperation with the ice bagging apparatus and configured to receive the plurality of ice bags from the ice bagging apparatus and maintain the ice within the ice bags in a frozen state, a passageway large enough to pass the ice bags and connecting an interior space of the ice bagging apparatus with an interior space of the ice bag merchandiser, and at least one ice bag diverter proximate the passageway and positionable between a first position and a second position and having first and second opposing cradles, each of the first and second cradles configured to alternately receive at least first and second ice bags of the plurality of ice bags from the ice bagging apparatus via the passageway and drop the first and second ice bags to respective first and second regions of the ice bag merchandiser. In particular implementations, the first cradle dropping the first ice bag into the ice bag merchandiser positions the second cradle to receive the second ice bag and the second cradle dropping the second ice bag into the ice bag merchandiser positions the first cradle to receive a third ice bag of the plurality of ice bags.

Particular implementations may also include one or more of the following. At least a portion of the at least one ice bag diverter may be located in the ice bag merchandiser. The at least one ice bag diverter may be configured to pivot between the first position and the second position. The at least one ice bag diverter may be configured such that when it receives the first ice bag in the first cradle, the ice bag diverter automatically pivots to the second position. The at least one ice bag diverter may be configured to automatically pivot to the second position under force of gravity. The at least one ice bag diverter may further be configured such that when it receives the second ice bag in the second cradle, the ice bag diverter automatically pivots to the first position under force of gravity. The at least one ice bag diverter may further be configured such that when it receives the second ice bag in the second cradle, the ice bag diverter automatically pivots to the first position. entations, the at least one ice bag diverter may comprise at least two ice bag diverters, each independently positionable between respective first and second positions. A dividing wall may be included between the at least two ice bag diverters. A second of the at least two ice bag diverters may be configured to drop one or more ice bags of the plurality of ice bags to respective third and fourth regions of the ice bag merchandiser.

In another aspect, a method of forming a plurality of ice bag stacks in an ice bag merchandiser may comprise: producing a plurality of ice bags in an ice bagging apparatus, passing each of the plurality of ice bags from the ice bagging apparatus to an ice bag distributor via a passageway, receiving a first ice bag of the plurality of ice bags in a first cradle of an ice bag diverter in a first position, pivoting the ice bag diverter from the first position to a second position, and dropping the first ice bag to a first region of the ice bag merchandiser, and receiving a second ice bag of the plurality of ice bags in a second cradle of the ice bag diverter in the second position, pivoting the ice bag diverter back to the first position, and dropping the second ice bag to a second region of the ice bag merchandiser.

Particular implementations may also include one or more of the following. Pivoting the ice bag diverter from the first position to the second position may comprise automatically pivoting to the second position. Automatically pivoting to the second position may comprise automatically pivoting the ice bag diverter to the second position under the weight of the first ice bag. Pivoting the ice bag diverter back to the first position may comprise automatically pivoting back to the first position under the weight of the second ice bag. Pivoting the ice bag diverter back to the first position may comprise automatically pivoting back to the first position. Methods of forming a plurality of ice bag stacks may further comprise: receiving a third ice bag of the plurality of ice bags in a first cradle of a second ice bag diverter in a first position, pivoting the second ice bag diverter from the first position to a second position, and dropping the third ice bag to a third region of the ice bag merchandiser. Particular implementations of a method of forming a plurality of ice bag stacks may also further comprise receiving a fourth ice bag of the plurality of ice bags in a second cradle of the second ice bag diverter in the second position, pivoting the second ice bag diverter back to the first position, and dropping the fourth ice bag to a fourth region of the ice bag merchandiser.

In yet another aspect, an ice bagging assembly may comprise an ice bag merchandiser in mechanical cooperation with the ice bagging apparatus and configured to receive the plurality of ice bags from the ice bagging apparatus and maintain the ice within the ice bags in a frozen state, a passageway large enough to pass the ice bags and connecting an interior space of the ice bagging apparatus with an interior space of the ice bag merchandiser, and an ice bag distributor proximate the passageway, the ice bag distributor automatically positionable between a first position and a second position. In particular implementations, the ice bag distributor may be positionable to receive a first ice bag of the plurality of ice bags and drop the first ice bag to a first region of the ice bag merchandiser when the ice bag distributor is in a first position, and may be positionable to receive a second ice bag of the plurality of ice bags and drop the second ice bag to a second region of the ice bag merchandiser when the ice bag distributor is in a second position.

Particular implementations may also include one or more of the following. The ice bag distributor may be configured to automatically pivot between the first position and the second position. The ice bag distributor may be automatically positionable between the first position and the second position via one or more latitudinal tracks and one or more longitudinal tracks.

In still yet another aspect, a method of forming a plurality of ice bag stacks in an ice bag merchandiser may comprise: producing a plurality of ice bags in an ice bagging apparatus, passing each of the plurality of ice bags from the ice bagging apparatus to an ice bag distributor, receiving a first ice bag of the plurality of ice bags in an ice bag diverter in a first position, automatically positioning the ice bag diverter from the first position to a second position, and dropping the first ice bag to a first region of the ice bag merchandiser, and automatically positioning the ice bag diverter back to the first position from the second position, receiving a second ice bag of the plurality of ice bags in the ice bag diverter in one of the first position and the second position, and dropping the second ice bag to a second region of the ice bag merchandiser.

Particular implementations may also include one or more of the following. Automatically positioning the ice bag diverter from the first position to the second position may comprise automatically pivoting the ice bag diverter to the second position under the weight of the first ice bag, and automatically positioning the ice bag diverter back to the first position from the second position may comprise automatically pivoting the ice bag diverter to the second position under the weight of the first ice bag. Automatically positioning the ice bag diverter from the first position to the second position may comprise automatically moving the ice bag diverter via one or more latitudinal tracks and one or more longitudinal tracks, and automatically positioning the ice bag diverter back to the first position from the second position may comprise automatically moving the ice bag diverter via one or more latitudinal tracks and one or more longitudinal tracks.

The foregoing and other aspects, features, and advantages will be apparent to those having ordinary skill in the art from the DESCRIPTION and DRAWINGS, and from the CLAIMS.

BRIEF DESCRIPTION OF THE DRAWINGS

An ice bagging assembly and associated methods of use will hereinafter be described in conjunction with the appended drawings, where like designations denote like elements, and.

DESCRIPTION

Figure 1:
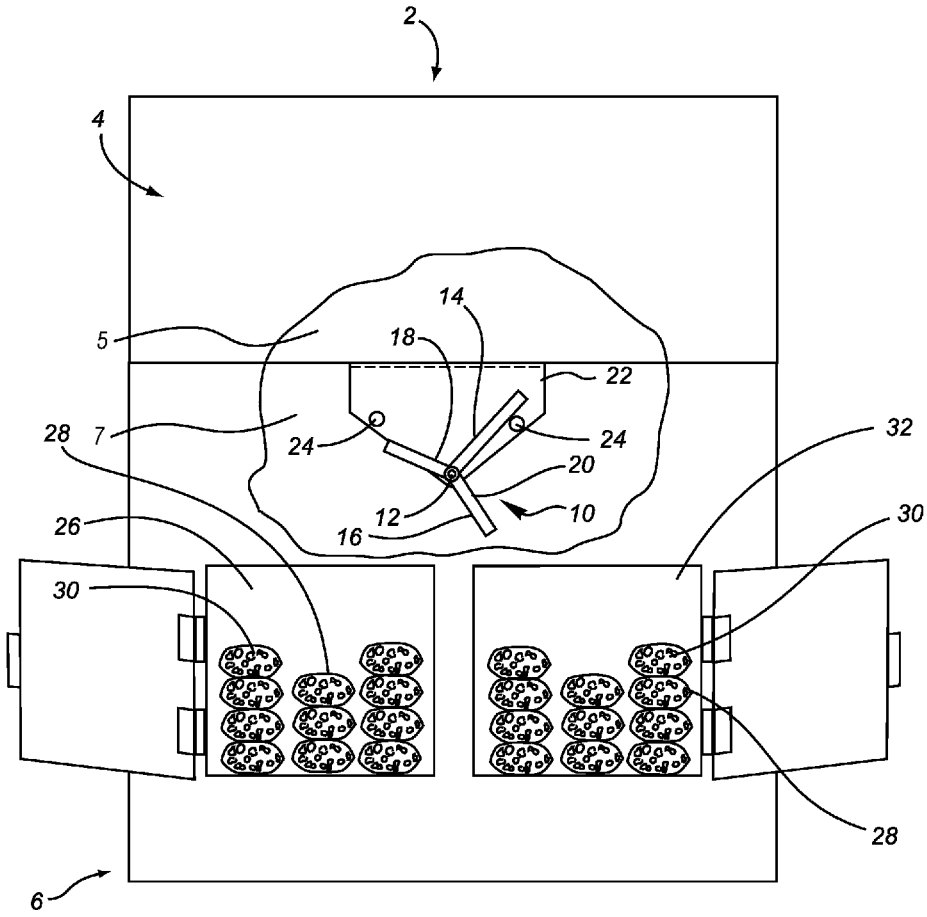
FIG. 1 illustrates a front view of a first particular implementation of an ice bagging assembly.

This disclosure, its aspects and implementations, are not limited to the specific components or assembly procedures disclosed herein. Many additional components and assembly procedures known in the art consistent with the intended operation of an ice bagging assembly and/or assembly procedures for an ice bagging assembly will become apparent from this disclosure. Accordingly, for example, although particular ice bagging apparatuses, ice bag merchandisers, passageways, interior spaces, ice bag diverters, first positions, second positions, first and second opposing cradles, regions, stops, frames, motors, ice bags, stacks, pivots, mechanical limiters, longitudinal tracks, latitudinal tracks, doors, and other components are disclosed, such particular ice bagging apparatuses, ice bag merchandisers, passageways, interior spaces, ice bag diverters, first positions, second positions, first and second opposing cradles, first and second regions, third and fourth regions, pivots, mechanical limiters, longitudinal tracks, latitudinal tracks, doors, and implementing components, may comprise any shape, size, style, type, model, version, measurement, concentration, material, quantity, and/or the like as is known in the art for such ice bagging assemblies, consistent with the intended operation of an ice bagging assembly.

There is a variety of ice bagging assembly implementations disclosed herein. FIGS. 1-4 illustrate various aspects of a first particular implementation of an ice bagging assembly 2, with the following description explaining this, and other, particular implementations. An ice bagging assembly 2 (and other particular implementations of ice bagging assemblies disclosed herein) comprises an ice bagging apparatus 4. An ice bagging apparatus 4 (and other particular implementations of ice bagging apparatuses described herein) is configured to produce a plurality of ice cubes within an interior space 5 and seal the plurality of ice cubes in a plurality of ice bags 28. The plurality of ice bags 28 are received in an ice bag merchandiser 6, such as a freezer, which is in mechanical cooperation with an ice bagging apparatus 4. An ice merchandiser 6 is configured to receive the plurality of ice bags 28 from an ice bagging apparatus 4 and maintain the ice within the plurality of ice bags 28 in a frozen state. Therefore, it will be understood that an interior space 7 of the ice merchandiser 6 is maintained at a sufficiently low temperature to keep the ice in the plurality of ice bags 28 frozen. An ice bagging assembly (such as ice bagging assembly 2) may be placed in a variety of locations, and a plurality of ice bags 28 may be conveniently provided to users such as retail customers, wholesale customers, and/or other consumers.

Figure 2:
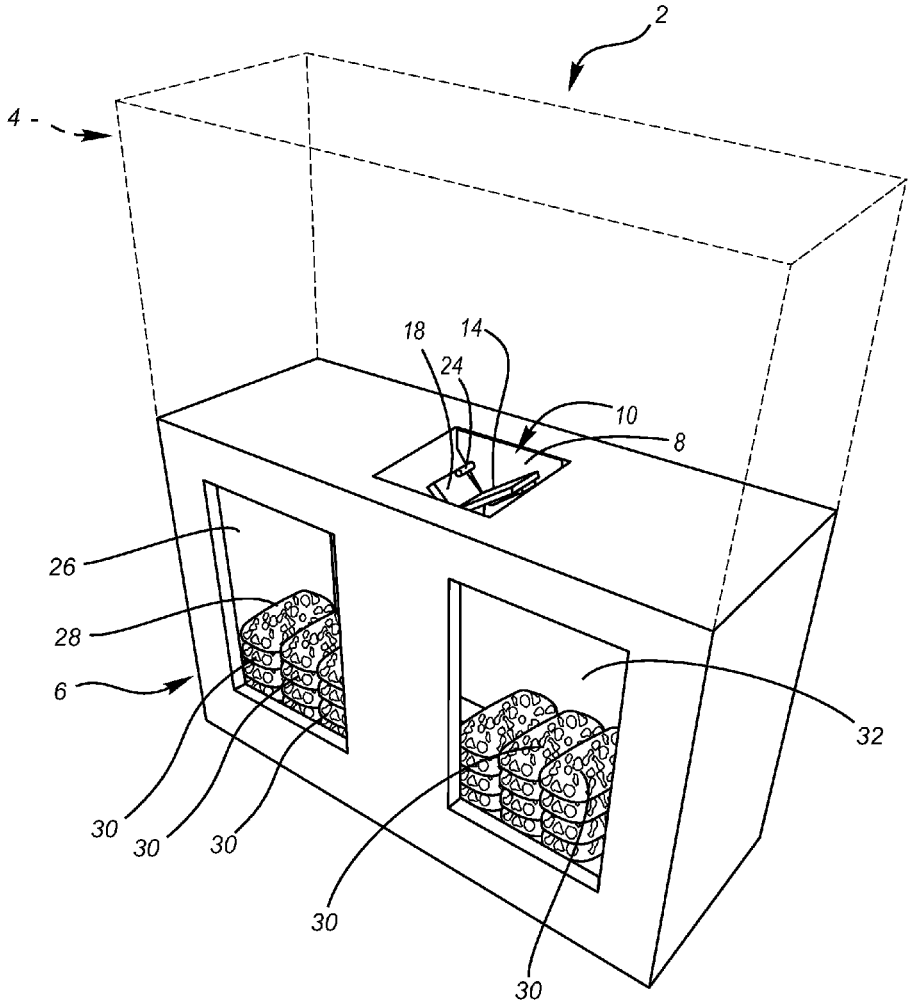
FIG. 2 illustrates a perspective view of the assembly shown in FIG. 1.

A passageway 8 (FIG. 2) connects an interior space 5 of an ice bagging apparatus 4 with an interior space 7 of an ice bag merchandiser 6. The passageway 8 is large enough to permit passage of each of the plurality of ice bags 28. In some particular implementations of an ice bagging assembly, a passageway 8 may be fixed in location and/or position such that each of the plurality of ice bags 28 are passed in substantially the same location and/or position from an interior space 5 of an ice bagging apparatus 4 to an interior space 7 of an ice merchandiser 6. In other particular implementations of an ice bagging assembly, a passageway 8 may be moveable in location and/or position such that two or more of the plurality of ice bags 28 are passed in a substantially different location and/or position from an interior space 5 of an ice bagging apparatus 4 to an interior space 7 of an ice merchandiser 6. In FIG. 2, the front doors have been removed for convenience of illustration.

Referring now specifically to the first particular implementation of ice bagging assembly 2 illustrated in FIGS. 1-4, at least one ice bag diverter 10 is located proximate the passageway 8. In some particular implementations, an ice bag diverter (such as ice bag diverter 10) may be partially or entirely located in an ice bag merchandiser 6. In other particular implementations, an ice bag diverter may be partially or entirely located in an ice bagging apparatus 4. An ice bag diverter 10 comprises a vertical member 14 and one or more transverse members 16. As illustrated, the intersection of the one or more transverse members 16 with the vertical member 14 forms two opposing cradles, a first opposing cradle 18 and a second opposing cradle 20. In some particular implementations, such as the one shown with respect to FIGS. 1-4, an ice bag diverter 10 may comprise one or more pivots 12, which may allow pivotal movement of the ice bag diverter 10 with respect to a support frame 22. In other particular implementations, an ice bag diverter may move between a first position and a second position without pivoting. In either case, an ice bag diverter 10 is mounted within the support frame 22 (via one or more pivots 12, in some particular implementations) such that an ice bag diverter 10 is permitted to move with respect to the support frame 22. Other non-pivoting, such as sliding or other movement, arrangements are also contemplated. Two or more stops 24 may be provided on the support frame 22 on one or more sides of the ice bag diverter 10 to assist in arresting the movement of an ice bag diverter 10 with respect to the support frame 22.

Figure 3:
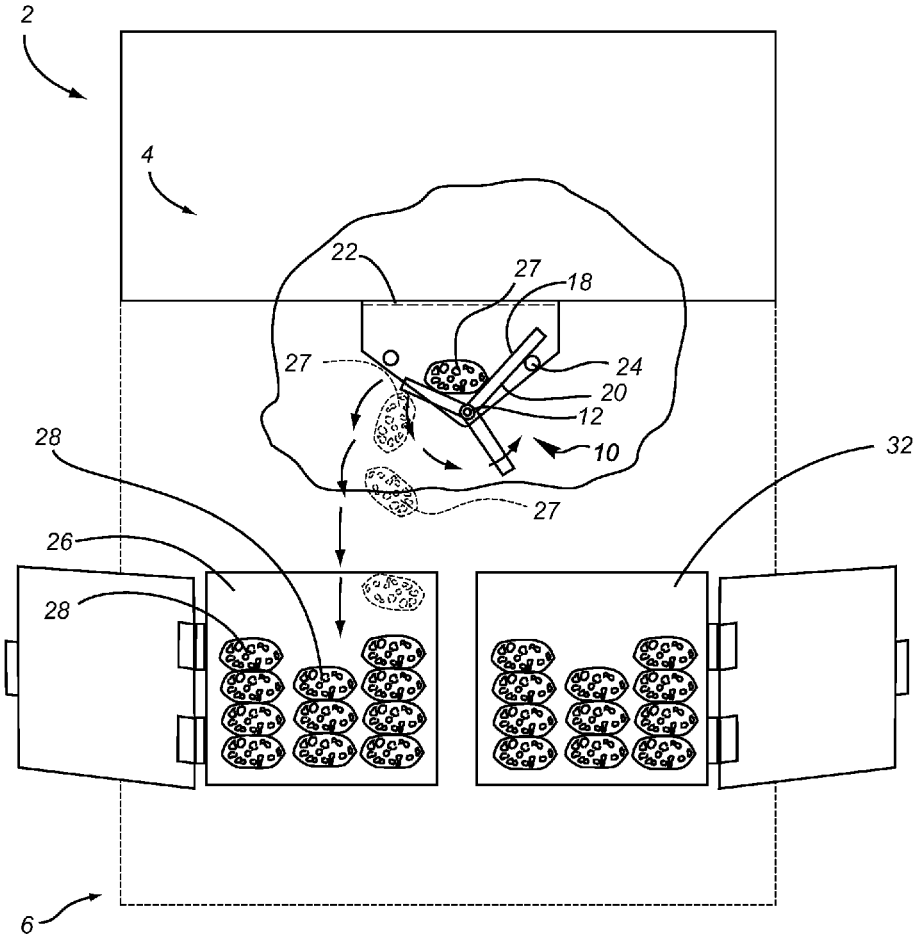
FIG. 3 illustrates an in-use view of the assembly shown in FIG. 1 with an ice bag diverter in a first position.
Figure 4:
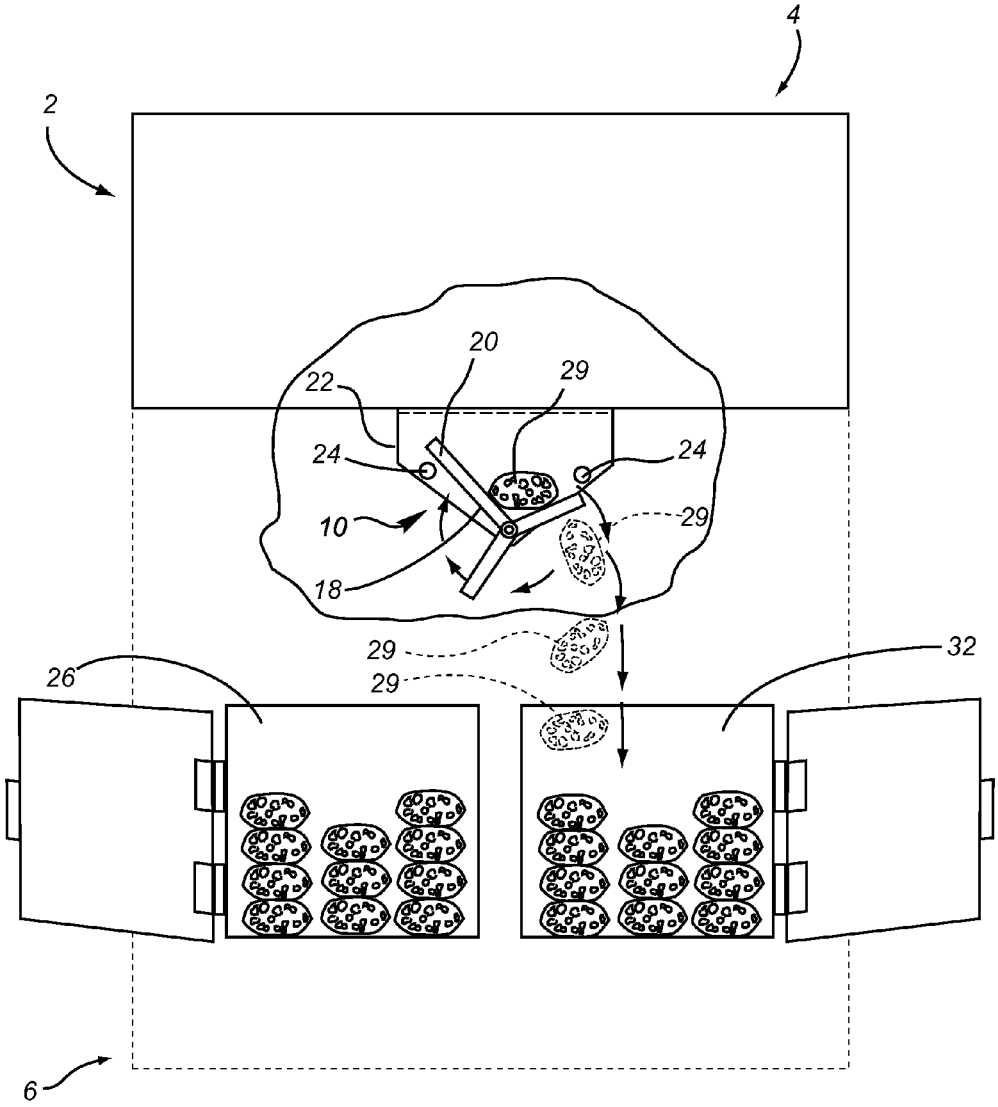
FIG. 4 illustrates an in-use view of the assembly shown in FIG. 1 with an ice bag diverter in a second position.

As seen from a comparison of FIG. 3 to FIG. 4, the at least one ice bag diverter 10 is positionable between a first position (FIG. 3) and a second position (FIG. 4). In some particular implementations, an ice bag diverter 10 is automatically positionable between a first position and a second position such as, by way of non-limiting example, when one or more of a plurality of ice bags 28 are introduced to one of a first opposing cradle 18 and a second opposing cradle 20. In such implementations where an ice bag diverter 10 is automatically positionable, the ice bag diverter 10 may be automatically positionable between a first position and a second position by an ice bag 28 initiating the ice bag diverter 10 into that position under the force of gravity, for instance, or any mechanical and/or electro-mechanical force.

For the particular implementation illustrated in FIGS. 3 and 4, the first opposing cradle 18 and the second opposing cradle 20 are each configured to alternately receive at least a first ice bag 27 (FIG. 3) and a second ice bag 29 (FIG. 4) of the plurality of ice bags 28 from an ice bagging apparatus 4 via the passageway 8 (best seen in the perspective view shown with respect to FIG. 2). The first opposing cradle 18 and the second opposing cradle 20 are each further configured to alternately drop the first and second ice bags 29 to respective first 26 (FIG. 3) and second 32 (FIG. 4) regions of the ice bag merchandiser 6.

In particular, FIG. 3 illustrates an ice bag diverter in a first position. In the first position, the first opposing cradle 18 is in a position to receive at least a first ice bag 27. As illustrated, in this particular implementation, when a first ice bag 27 is received in the first opposing cradle 18, the weight of the first bag 27 causes the ice bag diverter 10 (specifically, the first opposing cradle 18) to move downwardly such that the ice bag diverter 10 automatically moves toward the second position (FIG. 4) from the weight of the first ice bag 27. While a pivoting motion is illustrated with respect to the movement of the ice bag diverter 10, it will be understood that ice bag diverter implementations may move between a first position and a second position in various ways, including being acted upon by gravity, a bias or tension, mechanically or electro-mechanically, and/or any other way to cause and/or permit movement of an ice bag diverter between a first position and a second position. As the ice bag diverter 10 moves from the first position to the second position, the first ice bag 27 drops into a first region 26 of the ice merchandiser 6.

FIG. 4 illustrates the ice bag diverter 10 in a second position. In the second position shown in FIG. 4, the second opposing cradle 20 (of the ice bag diverter 10) is in position to receive at least a second ice bag 29. As illustrated, in this particular implementation, when a second ice bag 29 is received in the second opposing cradle 20, the weight of the second bag 29 causes the ice bag diverter 10 to pivot back to the first position. Specifically, the second opposing cradle 20 to move downwardly toward the first position (FIG. 3) from the weight of the second ice bag 29. As the ice bag diverter 10 moves from the second position to the first position, the second ice bag 29 drops into a second region 32 of the ice merchandiser 6.

Therefore, it will be understood that for this particular implementation, when a first opposing cradle 18 drops a first ice bag 27 into an ice bag merchandiser 6, the second opposing cradle 20 moves into a second position (FIG. 4), and becomes positioned to receive a second ice bag 29. Moreover, when the second opposing cradle 20 receives a second ice bag 29, the first opposing cradle 18 automatically moves (automatically pivoting, in this particular implementation) back into a first position (FIG. 3), and becomes positioned to receive a third ice bag, different from the first ice bag 27 and the second ice bag 29. The ice bag diverter may continue to move between the first position and the second position, successively receiving and dropping ice bags 28, until the ice merchandiser 6 becomes full, the ice bagging apparatus 4 runs out of ice bagging supplies, or some other predetermined event occurs.

One or more sensors may be provided in order to stop production of a plurality of ice bags 28 in the ice bagging apparatus 4 should the ice bag merchandiser become full and/or to issue an alert if the ice bagging apparatus 4 runs out of one or more ice bagging supplies (and/or otherwise becomes unable to make and/or bag ice). It will be understood that the plurality of ice bags 28, including the first ice bag 27, the second ice bag 29, the third ice bag, and/or any other ice bags disclosed herein, may be substantially identical in contents, size, shape, weight, etc., and that individual reference numbers have been used for the various ice bags described herein to aid in understanding the operation of the various implementations of ice bagging assemblies described herein.

As a plurality of ice bags 28 (which may include one or more first ice bags 27 and/or one or more second ice bags 29) accumulates in an ice merchandiser 6, one or more stacks 30 may be formed. While one or more stacks 30 of ice bags 28 are shown in the various figures described herein as neatly organized, discrete columns of ice bags 28, it will be understood that as one or more of the plurality of ice bags 28 (including one or more first ice bags 27 and/or one or more second ice bags 29) drops into an ice merchandiser 6, the one or more ice bags 28 may settle into their respective regions (i.e. first region 26 and second region 32 and/or any other regions disclosed herein) in a manner that does not necessarily form neat stacks 30 (FIG. 2). For many of the particular implementations disclosed herein, dropping ice bags into different regions of the ice merchandiser to form different stacks allows the ice bag merchandiser to fit significantly more ice bags within the ice merchandiser than is fit in a conventional merchandiser that drops all ice bags into the same region of the ice merchandiser. More ice bags in the merchandiser at a time can result in higher sales volumes.

Figure 5:
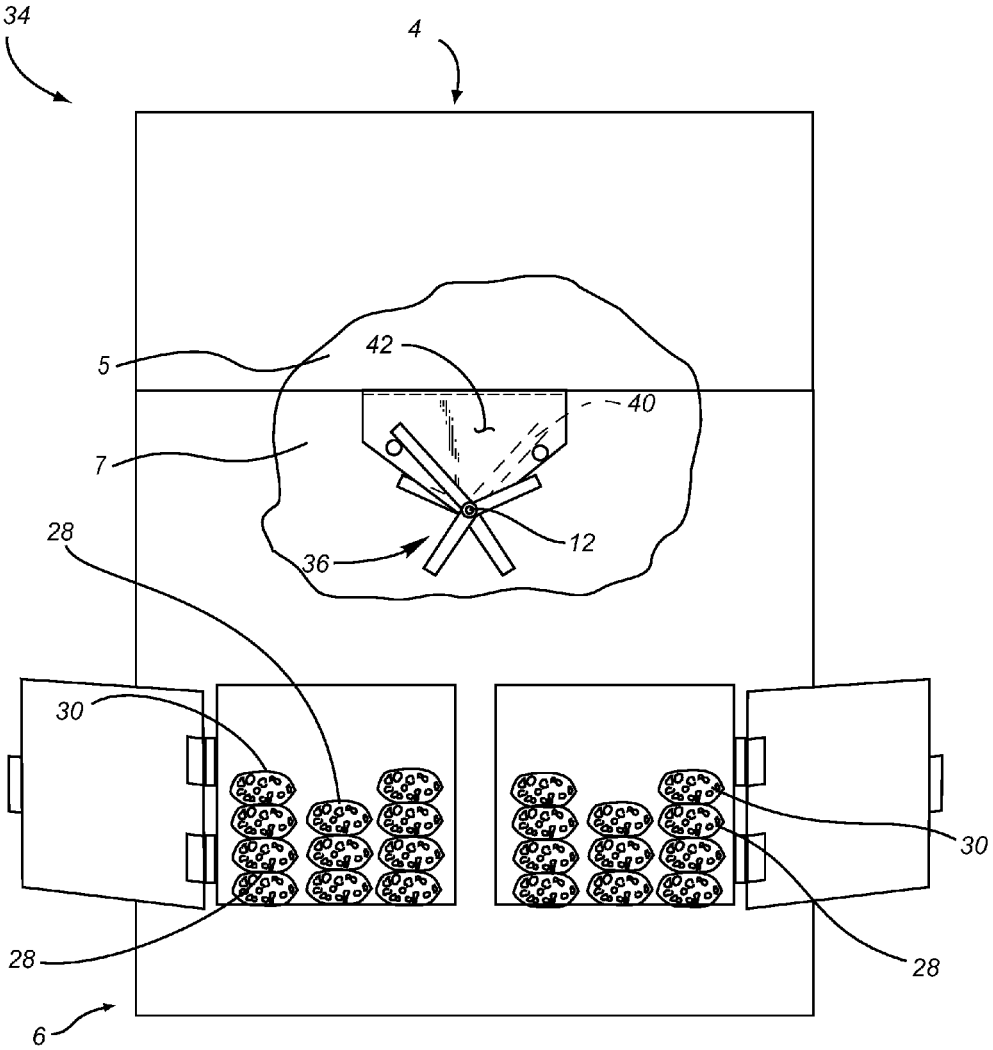
FIG. 5 illustrates a second particular implementation of an ice bagging assembly.
Figure 6:
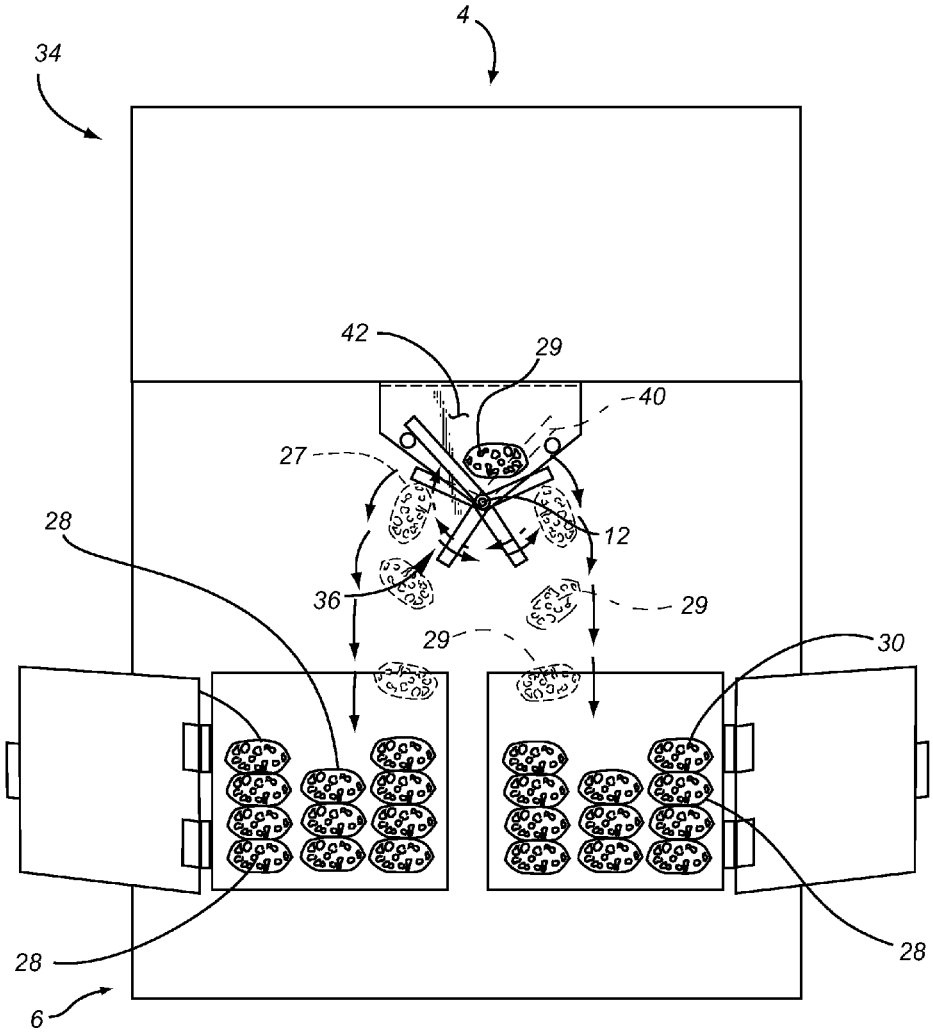
FIG. 6 illustrates an in-use view of the assembly shown in FIG. 5.

Turning now to FIGS. 5 and 6, a second particular implementation of an ice bagging assembly 34 is illustrated. Like the first particular implementation of ice bagging assembly 2, ice bagging assembly 34 comprises an ice bagging apparatus 4 configured to produce a plurality of ice cubes within an interior space 5 and seal the plurality of ice cubes in a plurality of ice bags 28. As with the first particular implementation, the plurality of ice bags 28 are received in an ice merchandiser 6, which is in mechanical cooperation with the ice bagging apparatus 4. The ice merchandiser 6 is configured to receive the plurality of ice bags 28 from the ice bagging apparatus 4 and maintain the ice within the plurality of ice bags 28 in a frozen state. Just as with the first particular implementation, a passageway (see FIG. 1 for example) connects an interior space 5 of the ice bagging apparatus 4 with an interior space 7 of the ice merchandiser 6.

In addition to the foregoing aspects and features, an ice bagging assembly 34 further comprises at least two ice bag diverters (a first ice bag diverter 36 and a second ice bag diverter 40, in this particular implementation). The first ice bag diverter 36 and a second ice bag diverter 40, are each independently positionable between respective first and second positions (in FIG. 5, the first ice bag diverter 36 is shown in a second position and the second ice bag diverter 40 is shown in a first position). While the first ice bag diverter 36 and the second ice bag diverter 40 are shown in opposite positions, it will be understood that the first ice bag diverter 36 and the second ice bag diverter 40 may each be independently positionable such that first ice bag diverter 36 and the second ice bag diverter 40 may each be at the same respective first positions or same respective second positions at the same time (although in different planes). In some particular implementations, such as in an ice bagging assembly 34, a first ice bag diverter 36 and a second ice bag diverter 40 are separated by a dividing wall 42.

Referring specifically to FIG. 6, the first ice bag diverter 36 and second ice bag diverter 40 may separately operate similarly to ice bag diverter 10 described above with respect to the first particular implementation of ice bagging assembly 2. In this particular implementation, each of the first and second diverters 36 and 40 includes its own first and second cradles separately operating as described with reference to the single diverter 10 implementation of FIGS. 1-4. Because each of the first and second diverters is positionally side-by-side and each drops to different regions, the ice merchandiser 6 interior space 7 may be divided into four general regions rather than just the two described with reference to FIGS. 1-4. From this explanation, it will be clear to those of ordinary skill in the art that with slight modifications any number of ice merchandiser regions may be defined and diverters may be implemented to further maximize use of the interior space 7 of the ice merchandiser 6. The ice bagging assembly 34 of this particular implementation is configured to create at least four stacks 30 in the ice merchandiser 6 (including one or more stacks 30 from a first ice bag diverter 36 in each of a respective first region and a second region, as well as a one or more stacks 30 from a second ice bag diverter 40 in each of a respective third region and a fourth region of the ice merchandiser 6).

Turning now to FIGS. 7-12, a third particular implementation of an ice bagging assembly 44 is illustrated, but the front doors have been removed for convenience of illustration. Like the first and second particular implementations, an ice bagging assembly 44 comprises an ice bagging apparatus 4 configured to produce a plurality of ice cubes within an interior space and then seal the plurality of ice cubes in a plurality of ice bags 28. As with the first and second particular implementations, the plurality of ice bags 28 are received in an ice merchandiser 6, which is in mechanical cooperation with the ice bagging apparatus 4. The ice merchandiser 6 is configured to receive the plurality of ice bags 28 from the ice bagging apparatus 4 and maintain the ice within the plurality of ice bags 28 in a frozen state. Just as with the first and second particular implementations, a passageway 46 (FIG. 12) connects an interior space of the ice bagging apparatus 4 with an interior space of the ice merchandiser 6.

Figure 11:
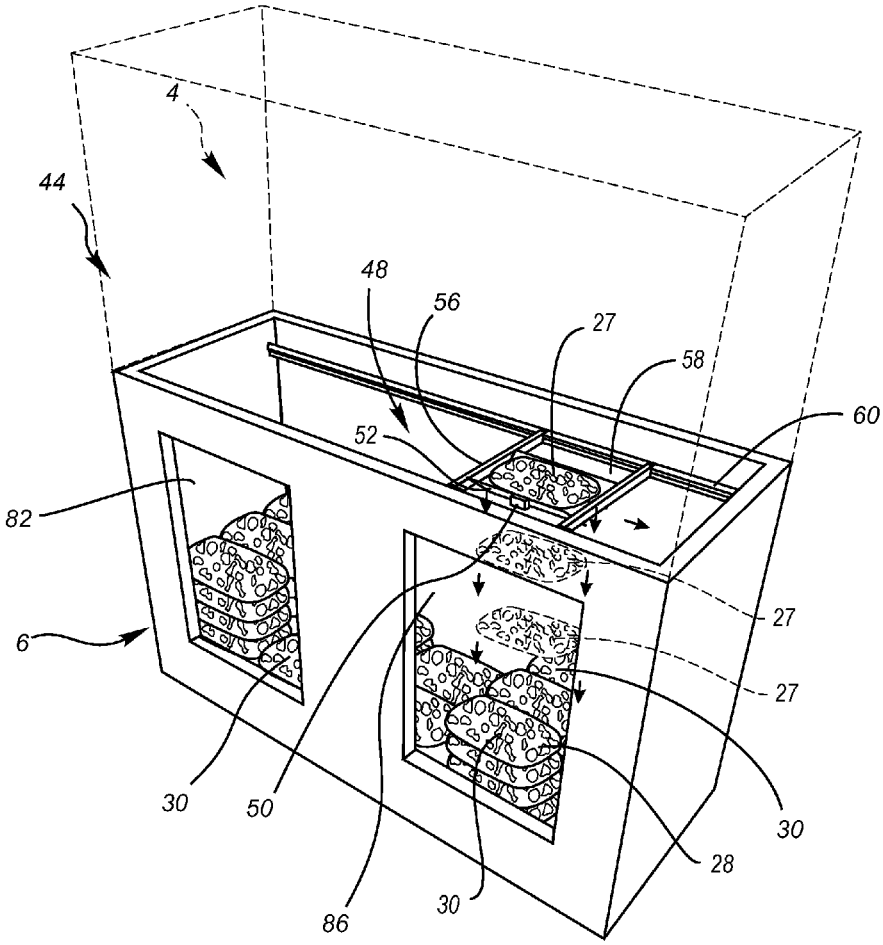
FIG. 11 illustrates an in-use view of the assembly shown in FIG. 7 with an ice bag diverter in a first position.
Figure 12:
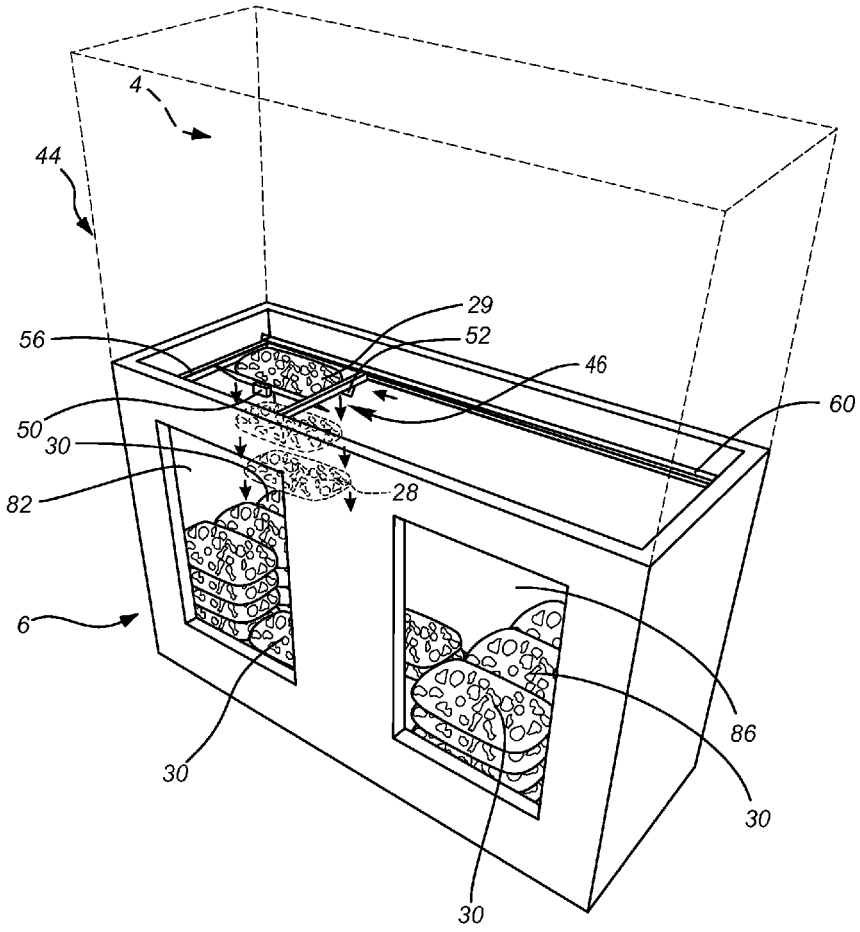
FIG. 12 illustrates an in-use view of the assembly shown in FIG. 7 with an ice bag diverter in a second position.

In addition to the foregoing aspects and features, an ice bagging assembly 44 further comprises an ice bag diverter 48 that is automatically positionable between a first position and a second position. The ice bag diverter 48 of this particular implementation is automatically positionable via one or more longitudinal tracks 56 and/or one or more latitudinal tracks 60. In particular, the ice bag diverter 48 is positionable to receive a first ice bag 27 (FIG. 11) and then drop the first ice bag 27 to a first region 86 of the ice bag merchandiser 6 when the ice bag diverter 48 is in a first position (FIG. 11). Likewise, the ice bag diverter 48 is positionable to receive a second ice bag 29 and then drop the second ice bag 29 to a second region 82 of the ice bag merchandiser 6 when the ice bag diverter 48 is in a second position (FIG. 12).

In some particular implementations, an ice bag diverter 48 may receive a first ice bag 27 when the ice bag diverter 48 is in the first position (FIG. 11), and may then drop the first ice bag 27 in a region of an ice merchandiser 6 other than the first region 86. In other particular implementations, the ice bag diverter 48 may move to the same receiving position each time (e.g. one of a first position, a second position, and/or any other possible position along one or both of the longitudinal tracks 56 and/or one or more latitudinal tracks 60) to receive one or more ice bags 28 (including a first ice bag 27). Nevertheless, after receiving an ice bag 28, the ice bag diverter 48 may move away from a first position to different regions in the ice bag merchandiser to drop the ice bag 28. Such movement may occur randomly, in some predetermined pattern, and/or based on one or more measurements of one or more stacks 30 and/or regions inside the ice bag merchandiser 6. The one or more measurements of the one or more stacks 30 and/or regions inside the ice bag merchandiser 6 may include, but is not limited to, ultrasonic, video or other spatial determination mechanism to evaluate where additional ice bags 28 are needed within the ice bag merchandiser 6, such as on the lowest stack. The spatial determination mechanism may be mounted to the ice bag diverter 48, to the associated tracks 56 or 60, or incorporated into the housing of the one or more motors 50. Alternatively, the spatial determination mechanism may be mounted in another stationary position within the ice bag merchandiser 6, such as to a wall.

Figure 7:
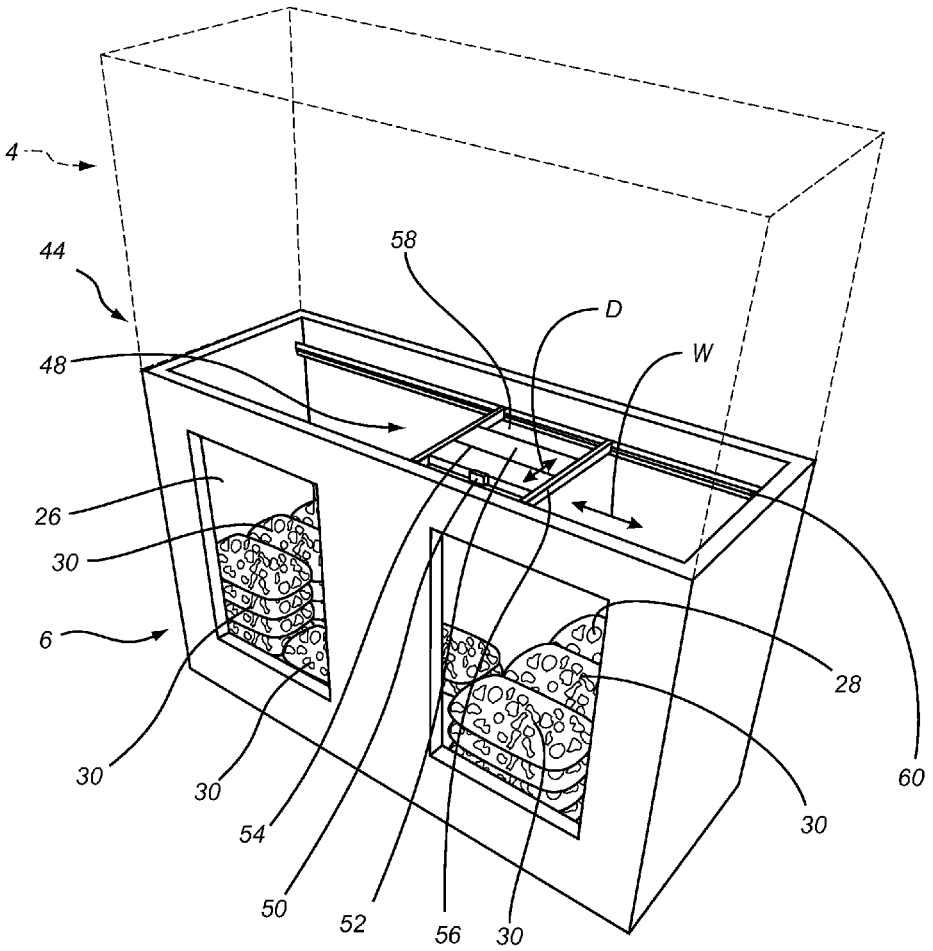
FIG. 7 illustrates a perspective view of a third particular implementation of an ice bagging assembly with an ice bag diverter in a first position.
Figure 8:
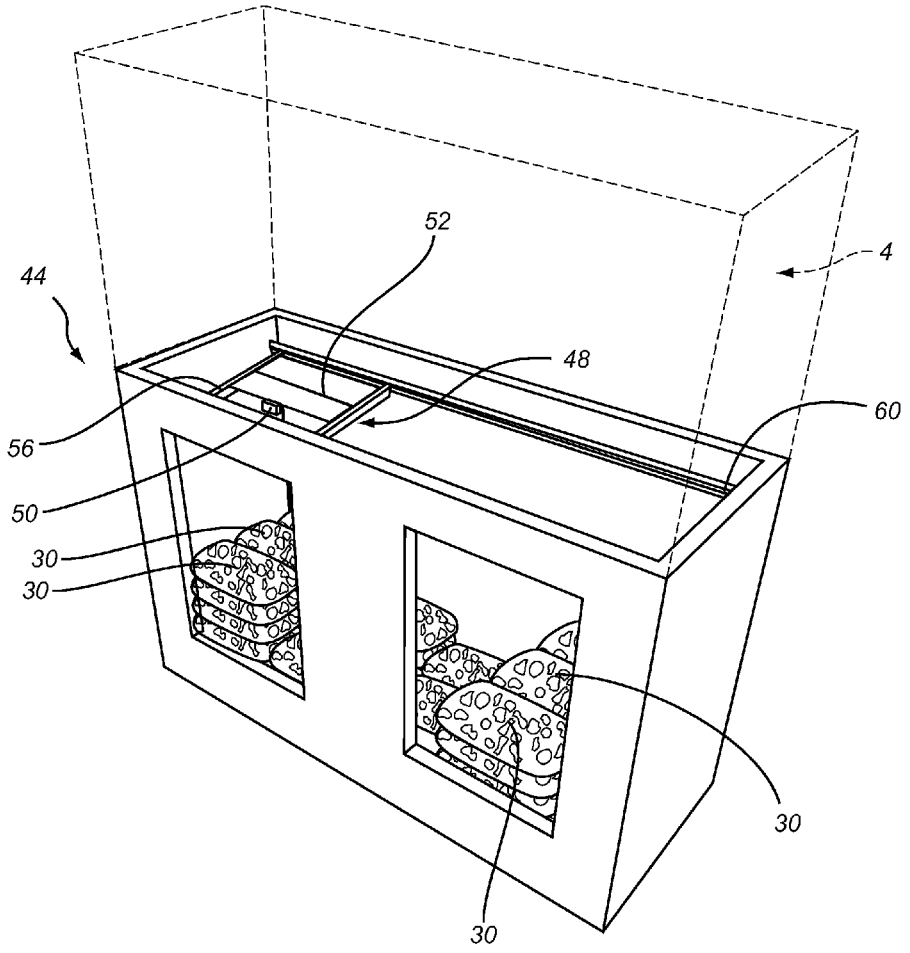
FIG. 8 illustrates a perspective view of the assembly shown in FIG. 7 with an ice bag diverter in a second position.
Figure 9:
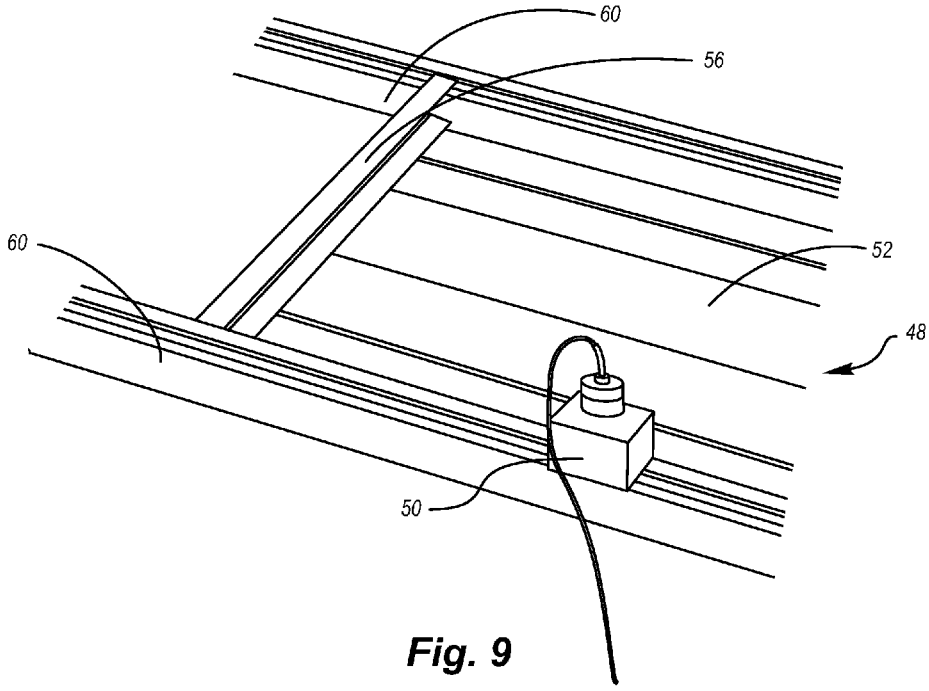
FIG. 9 illustrates a first detailed perspective view of the assembly shown in FIG. 7.
Figure 10:
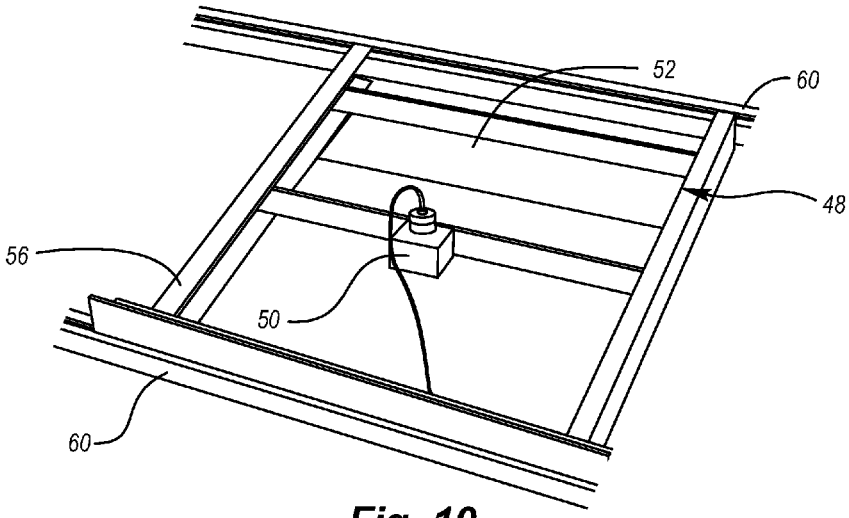
FIG. 10 illustrates a second detailed perspective view of the assembly shown in FIG. 8.

A comparison of FIG. 7 to FIG. 8 illustrates that the ice bag diverter 48 of this particular implementation has moved from a first position (FIG. 7) to a second position (FIG. 8), although it will be understood that the ice bag diverter 48 is capable of being positioned in many different positions (in addition to the first position 81 and the second position 83) via one or both of the longitudinal tracks 56 and/or one or more latitudinal tracks 60. Comparing FIG. 7 to FIG. 8 shows that the ice bag diverter 48 is capable of moving both along a width W of the ice bag merchandiser 6 (on one or more latitudinal tracks 60), as well as moving along a depth D of the ice bag merchandiser 6 (on one or more longitudinal tracks 56) via the mechanical assistance of one or more motors 50. A comparison of the gap 58 in FIG. 7 to the gap 58 in FIG. 8 illustrates the movement of the ice bag diverter 48 along the depth of the ice bag merchandiser 6, as occurring via one or more longitudinal tracks 56.

Still referring to FIGS. 7-12, the ice bag diverter 48 may comprise at least one door 52 that moves between a closed position (FIGS. 7 and 8) and an open position (FIGS. 11 and 12), in order to drop one or more ice bags 28 into the ice bag merchandiser 6. It will be understood that before the ice bag diverter receives an ice bag 28, the one or more doors 52 are in a closed position to support the weight of the ice bag 28. Nevertheless, once an ice bag diverter 48 has traveled to a region of an ice bag merchandiser 6 where it will drop an ice bag 28, the one or more doors 52 may move to an open position, and an ice bag 28 may drop to a respective region of the ice merchandiser 6 where the ice bag diverter 48 is located when the one or more doors 52 opens. An ice bag diverter 48 may be partially or entirely located within an ice bag merchandiser.

It will be understood by those of ordinary skill in the art that the concepts of providing a plurality of sealed ice bags to consumers, as disclosed herein, is not limited to the specific implementations shown and described herein. For example, it is specifically contemplated that the components included in any particular implementation of an ice bagging assembly may be formed of many different types of materials and/or combinations of materials that can readily be formed into shaped objects and that are consistent with the intended operation of an ice bagging assembly. For example, it is specifically contemplated that the components included in a particular implementation of an ice bagging assembly may be formed of any of many different types of materials or combinations that can readily be formed into shaped objects and that are consistent with the intended operation of an ice bagging assembly. For example, the components may be formed of: metals and/or other like materials; alloys and/or other like materials; polymers and/or other like materials; plastics, and/or other like materials; composites and/or other like materials; rubbers (synthetic and/or natural) and/or other like materials; and/or any combination of the foregoing.

Furthermore, the ice bagging apparatuses, ice bag merchandisers, passageways, interior spaces, ice bag diverters, first positions, second positions, first and second opposing cradles, regions, stops, frames, motors, ice bags, stacks, pivots, mechanical limiters, longitudinal tracks, latitudinal tracks, doors, and other components are disclosed, such particular ice bagging apparatuses, ice bag merchandisers, passageways, interior spaces, ice bag diverters, first positions, second positions, first and second opposing cradles, first and second regions, third and fourth regions, pivots, mechanical limiters, longitudinal tracks, latitudinal tracks, doors, and implementing components, along with any other components forming a particular implementation of an ice bagging assembly, may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

It will be understood that particular implementations of ice bagging assemblies are not limited to the specific components disclosed herein, as virtually any components consistent with the intended operation of a method and/or system implementation for an ice bagging assembly may be utilized. Accordingly, for example, although particular ice bagging apparatuses, ice bag merchandisers, passageways, interior spaces, ice bag diverters, first positions, second positions, first and second opposing cradles, regions, stops, frames, motors, ice bags, stacks, pivots, mechanical limiters, longitudinal tracks, latitudinal tracks, doors, and other components are disclosed, such particular ice bagging apparatuses, ice bag merchandisers, passageways, interior spaces, ice bag diverters, first positions, second positions, first and second opposing cradles, first and second regions, third and fourth regions, pivots, mechanical limiters, longitudinal tracks, latitudinal tracks, doors, and other components may be disclosed, such components may comprise any shape, size, style, type, model, version, class, grade, measurement, concentration, material, weight, quantity, and/or the like, consistent with the intended operation of a method and/or system implementation for an ice bagging assembly, may be used.

In places where the description above refers to particular implementations of an ice bagging assembly, it should be readily apparent that a number of modifications may be made without departing from the spirit thereof and that these implementations may be applied to other ice bagging assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. An ice bagging assembly comprising:

an ice bagging apparatus configured to generate a plurality of ice cubes and seal them in a plurality of ice bags;

an ice bag merchandiser in mechanical cooperation with the ice bagging apparatus, the ice bag merchandiser configured to receive the plurality of ice bags from the ice bagging apparatus and maintain the ice within the ice bags in a frozen state;

a passageway connecting an interior space of the ice bagging apparatus with an interior space of the ice bag merchandiser, the passageway sized to permit passage of each of the plurality of ice bags; and at least one ice bag diverter proximate the passageway, the at least one ice bag diverter positionable between a first position and a second position and having first and second opposing cradles, each of the first and second cradles configured to alternately receive at least first and second ice bags of the plurality of ice bags from the ice bagging apparatus via the passageway and drop the first and second ice bags to respective first and second regions of the ice bag merchandiser;

wherein the first cradle dropping the first ice bag into the ice bag merchandiser positions the second cradle to receive the second ice bag and the second cradle dropping the second ice bag into the ice bag merchandiser positions the first cradle to receive a third ice bag of the plurality of ice bags.

2. The assembly of claim 1, wherein at least a portion of the at least one ice bag diverter is in the ice bag merchandiser.

3. The assembly of claim 1, wherein the at least one ice bag diverter is configured to pivot between the first position and the second position.

4. The assembly of claim 3, wherein the at least one ice bag diverter is configured such that when it receives the first ice bag in the first cradle, the ice bag diverter automatically pivots to the second position.

5. The assembly of claim 4, wherein the at least one ice bag diverter is configured to automatically pivot to the second position under force of gravity acting on the first ice bag.

6. The assembly of claim 5, wherein the at least one ice bag diverter is further configured such that when it receives the second ice bag in the second cradle, the ice bag diverter automatically pivots to the first position under force of gravity acting on the second ice bag.

7. The assembly of claim 4, wherein the at least one ice bag diverter is further configured such that when it receives the second ice bag in the second cradle, the ice bag diverter automatically pivots to the first position.

8. The assembly of claim 1, wherein the at least one ice bag diverter comprises at least two ice bag diverters, each independently positionable between respective first and second positions.

9. The assembly of claim 8, further comprising a dividing wall between the at least two ice bag diverters.

10. The assembly of claim 8, wherein a second of the at least two ice bag diverters is configured to drop one or more ice bags of the plurality of ice bags to respective third and fourth regions of the ice bag merchandiser.

11. A method of forming a plurality of ice bag stacks in an ice bag merchandiser, the method comprising:

producing a plurality of ice bags in an ice bagging apparatus;

passing each of the plurality of ice bags from the ice bagging apparatus to an ice bag diverter via a passageway;

receiving a first ice bag of the plurality of ice bags in a first cradle of the ice bag diverter in a first position, pivoting the ice bag diverter from the first position to a second position, and dropping the first ice bag to a first region of the ice bag merchandiser; and receiving a second ice bag of the plurality of ice bags in a second cradle of the ice bag diverter in the second position, pivoting the ice bag diverter back to the first position, and dropping the second ice bag to a second region of the ice bag merchandiser.

12. The method of claim 11, wherein pivoting the ice bag diverter from the first position to the second position comprises automatically pivoting to the second position.

13. The method of claim 12, wherein automatically pivoting to the second position comprises automatically pivoting the ice bag diverter to the second position under the weight of the first ice bag.

14. The method of claim 13, wherein pivoting the ice bag diverter back to the first position comprises automatically pivoting back to the first position under the weight of the second ice bag.

15. The method of claim 12, wherein pivoting the ice bag diverter back to the first position comprises automatically pivoting back to the first position.

16. The method of claim 11, further comprising:

receiving a third ice bag of the plurality of ice bags in a first cradle of a second ice bag diverter in a first position, pivoting the second ice bag diverter from the first position to a second position, and dropping the third ice bag to a third region of the ice bag merchandiser; and receiving a fourth ice bag of the plurality of ice bags in a second cradle of the second ice bag diverter in the second position, pivoting the second ice bag diverter back to the first position, and dropping the fourth ice bag to a fourth region of the ice bag merchandiser.

17. An ice bagging assembly comprising:

an ice bag merchandiser in mechanical cooperation with the ice bagging apparatus, the ice bag merchandiser configured to receive the plurality of ice bags from the ice bagging apparatus and maintain the ice within the ice bags in a frozen state;

a passageway connecting an interior space of the ice bagging apparatus with an interior space of the ice bag merchandiser, the passageway sized to permit passage of each of the plurality of ice bags; and an ice bag distributor proximate the passageway, the ice bag distributor automatically positionable between a first position and a second position;

wherein the ice bag distributor is positionable to the first position to receive a first ice bag of the plurality of ice bags and drop the first ice bag to a first region of the ice bag merchandiser when the ice bag distributor is in the second position; and wherein the ice bag distributor is positionable to the second position, different from the first position, to receive a second ice bag of the plurality of ice bags and drop the second ice bag to a second region of the ice bag merchandiser when the ice bag distributor is in the first position.

18. The assembly of claim 17, wherein the ice bag distributor is configured to automatically pivot between the first position and the second position.

19. A method of forming a plurality of ice bag stacks in an ice bag merchandiser, the method comprising:

producing a plurality of ice bags in an ice bagging apparatus;

passing each of the plurality of ice bags from the ice bagging apparatus to an ice bag diverter;

receiving a first ice bag of the plurality of ice bags in an ice bag diverter in a first position, automatically positioning the ice bag diverter from the first position to a second position, and dropping the first ice bag to a first region of the ice bag merchandiser from the second position;

receiving a second ice bag of the plurality of ice bags in the ice bag diverter in the second position, automatically positioning the ice bag diverter from the second position to the first position, and dropping the second ice bag to a second region of the ice bag merchandiser from the first position; and automatically positioning the ice bag diverter back to the first position from the second position, receiving a third ice bag of the plurality of ice bags in the ice bag diverter in the first position, and dropping the third ice bag to the first region of the ice bag merchandiser.

20. The method of claim 19, wherein automatically positioning the ice bag diverter from the first position to the second position comprises automatically pivoting the ice bag diverter to the second position under the weight of the first ice bag, and wherein automatically positioning the ice bag diverter back to the first position from the second position comprises automatically pivoting the ice bag diverter to the first position under the weight of the second ice bag.

* * * * *